US005947841A

United States Patent [19]

Silvestro

[11] Patent Number: 5,947,841

[45] Date of Patent: Sep. 7, 1999

[54] GOLF PUTTER HEAD

[75] Inventor: Charles A. Silvestro, Providence, R.I.

[73] Assignee: Artificer, Inc., Providence, R.I.

[21] Appl. No.: 08/855,294

[22] Filed: May 13, 1997

[51] Int. Cl.[6] ..... A63B 53/04

[52] U.S. Cl. ..... 473/341

[58] Field of Search ..... 473/324, 334, 473/335, 336, 337, 340, 341, 349, 350, 251, 255, 256, 313

[56] References Cited

U.S. PATENT DOCUMENTS

| | | | |
|---|---|---|---|
| 3,873,094 | 3/1975 | Sebo | 473/340 |
| 3,909,005 | 9/1975 | Piszel | 473/336 |
| 3,966,210 | 6/1976 | Rozmus . | |
| 4,121,832 | 10/1978 | Ebbing | 473/340 |
| 4,508,350 | 4/1985 | Duclos . | |
| 4,655,459 | 4/1987 | Antonious | 473/341 |
| 4,871,174 | 10/1989 | Kobayashi . | |
| 5,324,031 | 6/1994 | Green | 473/252 |
| 5,409,219 | 4/1995 | Saksun | 473/337 |
| 5,580,058 | 12/1996 | Coughlin | 473/340 |

*Primary Examiner*—Sebastiano Passaniti
*Attorney, Agent, or Firm*—Richard D. Zimmerman

[57] ABSTRACT

A golf putter head having a polyurethane body with a face, toe and heel, and having weighting material connected to toe and heel. The weighting material is inserted in chambers sealed with a plug, or alternatively is molded into the polyurethane body. The weighting material does not project through the putter face, giving a larger sweet spot and softer feel to the putter.

20 Claims, 3 Drawing Sheets

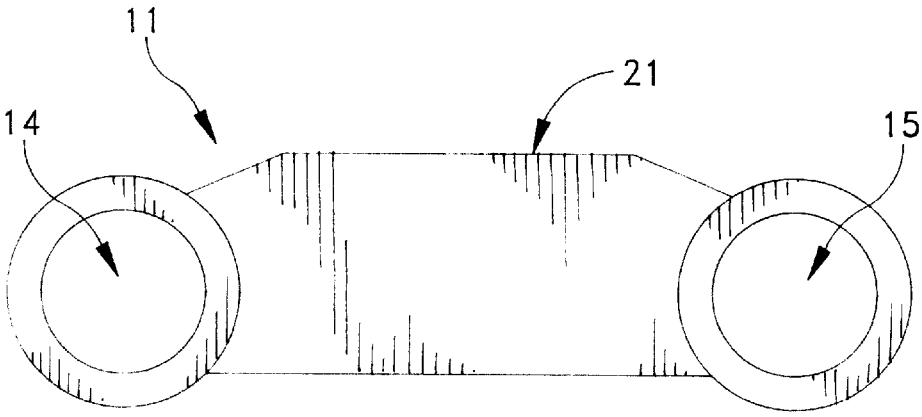
FIG. 2
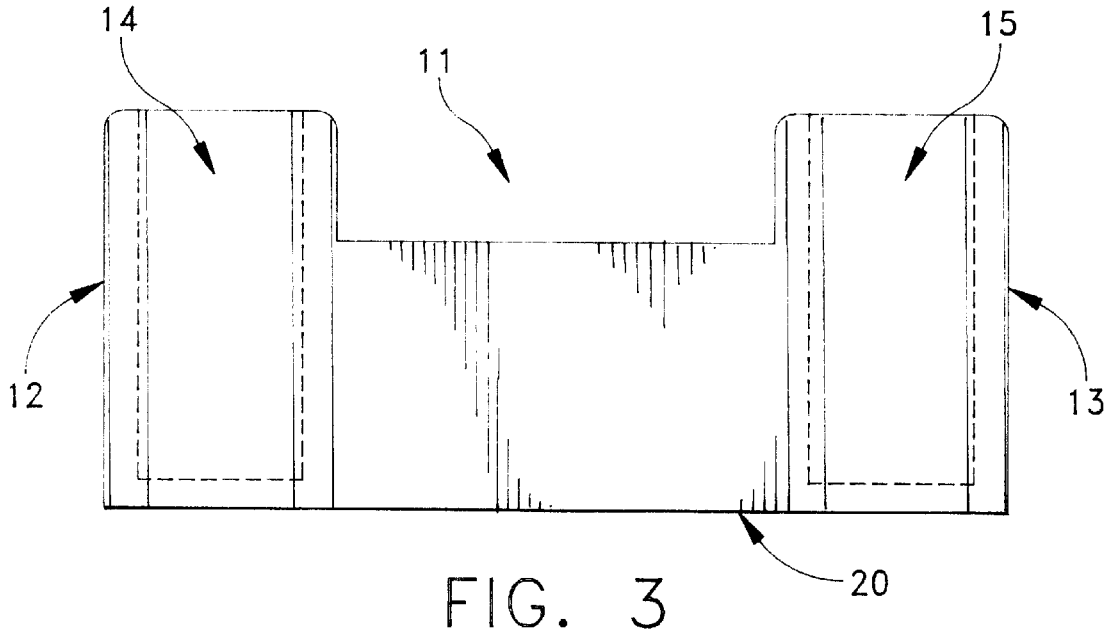
FIG. 3
FIG. 4
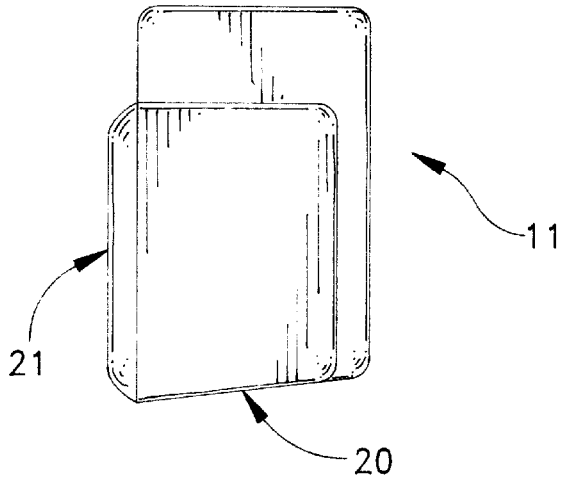

GOLF PUTTER HEAD

TECHNICAL FIELD

The technical field of this invention concerns golf putter heads.

BACKGROUND OF THE INVENTION

Golf putter heads have long been made from wood and metal. More recent efforts involve combining various materials.

Current theory in golf putter head design teaches that it is preferable to have a relatively large portion of the club face composed of material of a relatively low specific gravity. This gives the putter head a larger "sweet spot", which is generally understood as the area of the club face which can contact the golf ball, and still provide a true, accurate and desired trajectory of the golf ball. The larger the sweet spot, generally the more forgiving the club head is. That is, a larger sweet spot will permit satisfactory contact with the ball using a less perfect swing. A larger sweet spot generally improves the scores of most golfers.

It also is necessary to provide the putter head with a certain mass, generally in the range of 300 to 325 grams, to allow the transfer of sufficient momentum to the golf ball during putting. A variety of devices have been employed, including perimeter, bottom and heel and toe weighting, to concentrate the mass and thereby enlarge the sweet spot on the face of the putter. Other devices have used other materials as inserts or striking surface covers in attempts to concentrate the mass and enlarge the sweet spot.

Putter performance also is enhanced by a softer putting face. Conventional metal putters are relatively hard. While recent improvements, including inserts of softer materials on the putter face, yield better results, softer striking faces could further improve putter heads. Additionally, current devices and methods which modify softness require significant changes in weighting materials, thereby precluding relatively efficient and economic production of a range of putter heads of different softness.

Unlike golf clubs other than putters, which must withstand much greater forces of impact from the golf ball due to the harder swings, putters can be of much lower tensile strength and hardness than non-putter golf clubs.

Marketability of putter heads is enhanced if the putter can be colored in an economic and relatively permanent manner. Some golfers desire colorful putters. Current putter heads cannot be colored economically and relatively permanently. Paints and other coloring coatings scratch easily and are otherwise not very durable.

No currently marketed device is known to this applicant that employs a polyurethane body with concentrated weighting, to maximize the sweet spot, lower surface softness while maintaining acceptable club weight, and permitting color and softness variations without significant additional manufacturing expense.

SUMMARY OF THE INVENTION

The present invention is directed to a new device that improves performance characteristics and appearance of the putter head. A golf putter head having features of the present invention comprises a polyurethane body weighted with concentrated high specific gravity material.

The head can be designed to be attached to a conventional handle by a variety of common means. Similarly, the head can incorporate numerous features known in conventional clubs, such as a rounded bottom, an angled face, and desirable aesthetic design characteristics.

A BRIEF DESCRIPTION OF THE DRAWINGS

These and other features, aspects and advantages of the present invention will become better understood with regard to the following description, and its claims and drawings where:

FIG. 2 shows a rear plan view of the putter body;

FIG. 3 shows a sectional view of the golf putter body along the A—A axis shown in FIG. 2.

FIG. 4 shows a side plan view of the putter body.

DESCRIPTION OF THE BEST MODE

Figure 1:
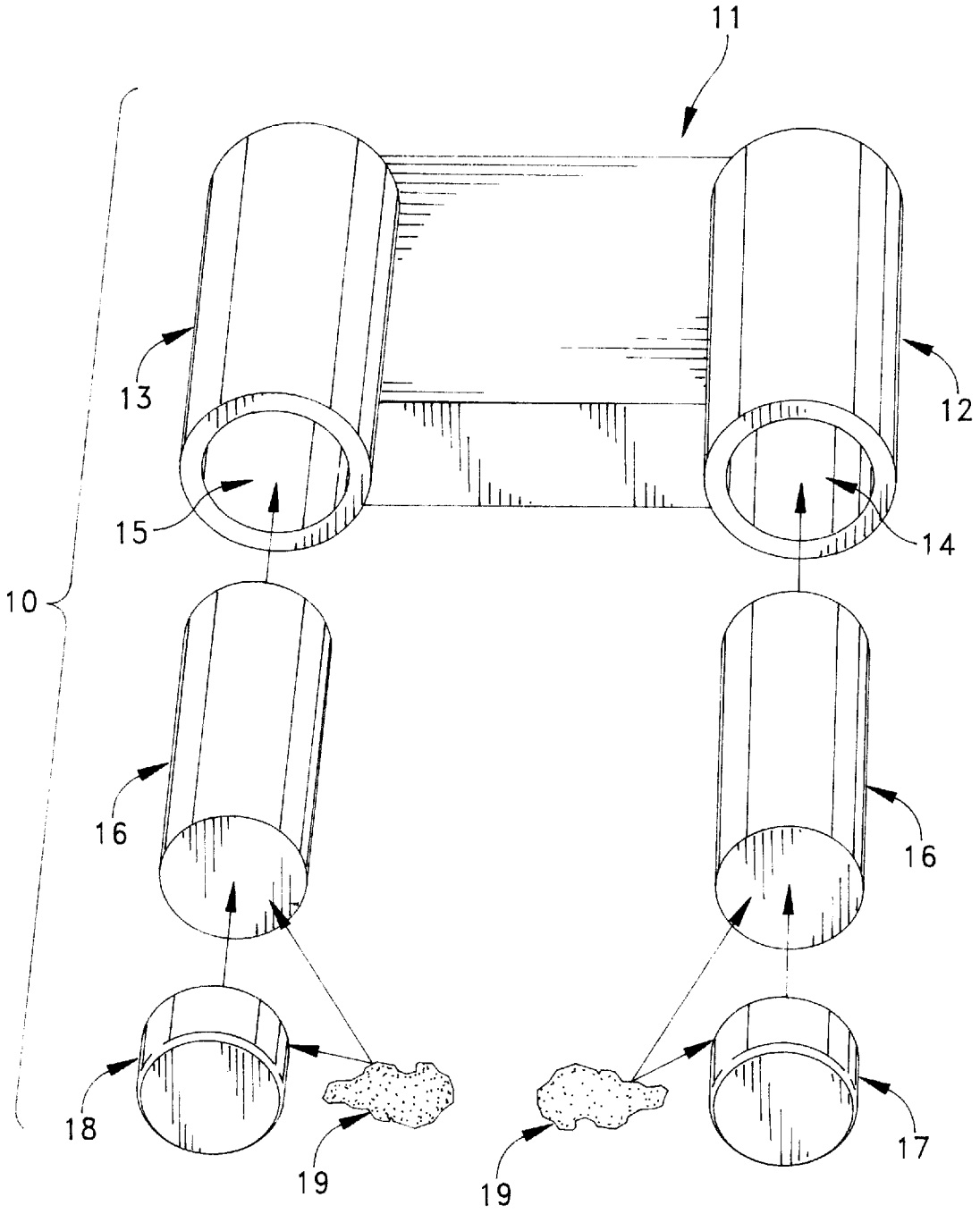
FIG. 1 shows a exploded perspective view of the golf putter head.
Figure 5:
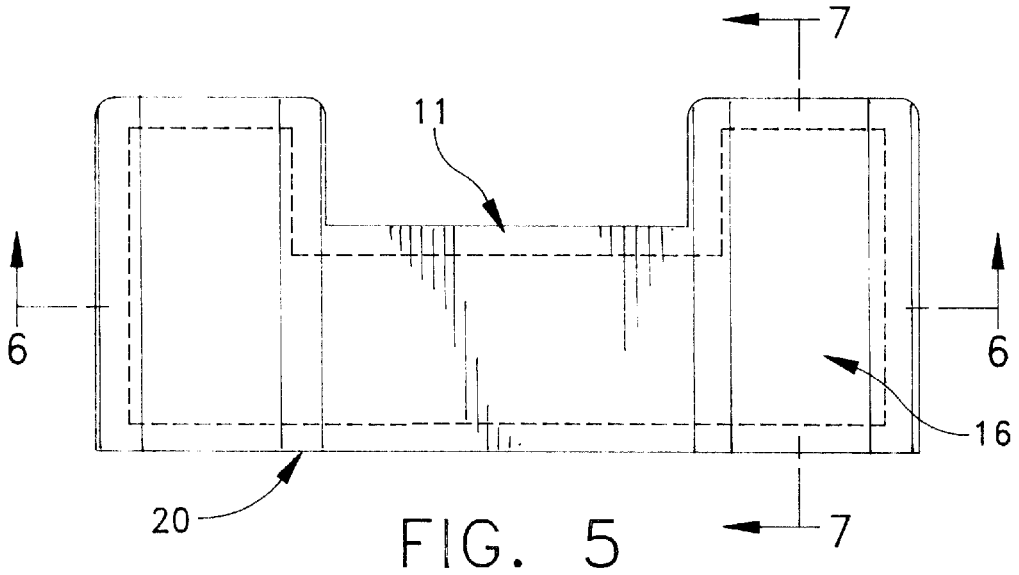
FIG. 5 shows a plan view of an alternate embodiment of the putter head.
Figure 6:
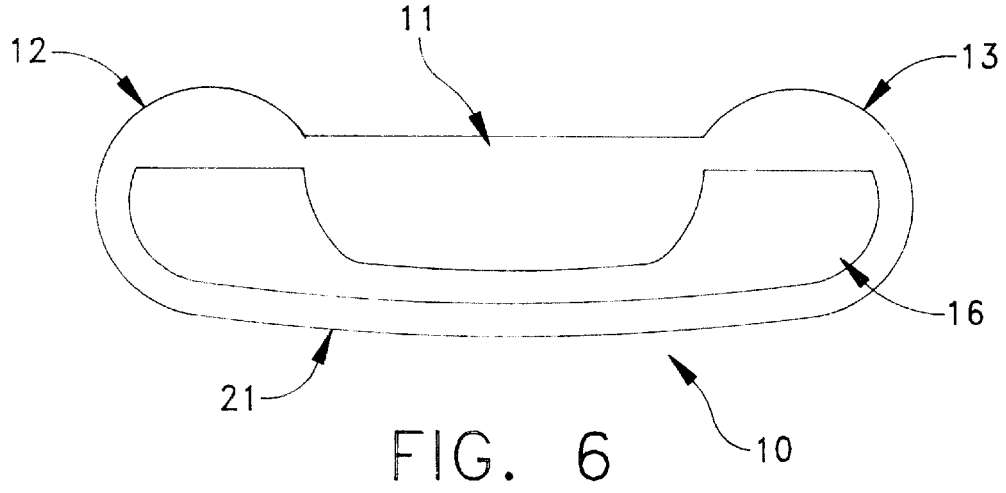
FIG. 6 shows a front sectional view of the putter head along the 6—6 axis shown in FIG. 5.
Figure 7:
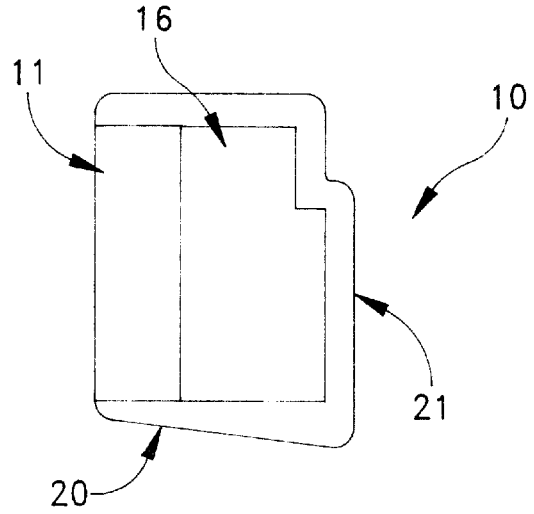
FIG. 7 shows a side sectional view of the putter head along the 7—7 axis shown in FIG. 5.

As shown in FIG. 1, one embodiment of the golf putter head 10 comprises a body 11 made of polyurethane, with a toe 12 and heel 13 and containing a toe weight chamber 14 and a heel weight chamber 15, which chambers are each filled with weighting material 16. In this embodiment, the weighting material is held in the chambers (14, 15) primarily by friction fit, and a toe plug 17 and a heel plug 18 are inserted respectively to cover the chambers (14, 15) for aesthetic reasons. The plugs (17, 18) are held in place by a plug attachment means 19.

The body (11) may be molded or cast from polyurethane using conventional techniques, including open casting, compression molding or transfer molding. The polyurethane here described is conventional material readily available, and is processed according to the manufacturers instruction. A polyether polyurethane is preferred, though a polyester could function adequately. The polyurethane can be of different hardness, though the preferred range of hardness is approximately 85A to 70D Shore hardness. Varying the type of polyurethane or the processing polyurethane, including curing materials and temperatures, the hardness can be varied. This allows production of a number of different putters to meet the range of golfers' preferences for the "feel" of the putter, without incurring significant additional manufacturing expenses. In casting the head, a mold is conventionally made.

The necessary mass of the putter head, from about 300 to 325 grams, is achieved by including a volume of high specific gravity weighting material (16) in or attached to the polyurethane body (11). The weighting material (16) can be included in toe (14) and heel (15) weight chambers, as in FIG. 1. Alternatively, the weighting material (16) can be concentrated along the approximate longitudinal axis of the head (10), or can be placed around the polyurethane at the toe, heel and the surface opposite the striking face 20 of the putter head (10). Generally, the low density of polyurethane relative to the high density of weighting material, if positioned properly, yields a larger sweet spot and a superior putter. In this embodiment, the putter head is approximately 70 to 85 percent polyurethane by volume.

As shown in FIG. 1, in one embodiment, weight chambers (14, 15) are created during the molding or casting of the body (1). This is generally more efficient and economical. Alternatively, after the polyurethane body (11) is cured, the toe weight chamber (14) and heel weight chamber (15) may be drilled using conventional techniques. The chambers (14, 15) are positioned to leave adequate polyurethane between the toe and heel chamber (14, 15) and the exterior of the body (11) to maintain adequate strength of the chamber walls. In the preferred embodiment, a thickness of approximately 1/16 to 3/16 inches of polyurethane or more, has proved adequate.

The toe weight chamber (14) and the heel weight chamber (15) are filled with weighting material (16), which can be any high specific gravity material. In one embodiment, the weighting material (16) is selected from the group of lead, bronze, brass, steel, tungsten, and zinc, and is friction fit in the weighting chambers. The primary selection criteria for weighting material (16) are high specific gravity, and relatively low cost. The specific gravity should exceed approximately 7.0, but lower specific gravity materials could be used with increasing diminishing of the sweet spot size as lower specific gravity materials are used.

In other embodiments, in which the weighting material is embedded or encased in the polyurethane, or the weighting material is outside of the urethane, an attaching means is necessary to relatively permanently attach the polyurethane body and the weighting material. In some embodiments, the polyurethane serves as the attaching means, as when the weighting material is embedded or encased in the polyurethane. In other embodiments, as when the weighting material is outside of the urethane, an epoxy or other adhesive may be required.

After the weighting material is placed in the toe weight chamber (14), and the heel weight chamber (15), the plug attachment means (19) seals the plugs (17, 18) into the chambers (14, 15) or the head. The plug attachment means (19) used in the present embodiment is common flexible epoxy, though a variety of other connecting materials are possible. The plug attachment means (19) should prevent the plugs (17, 18) from falling out of the chambers (14, 15) or away from the head during normal use of the putter head (10). The plug attachment means (19) can be adhesive material such as a flexible epoxy that hardens over the weighting material, attaches to the body (11) and is not removable without drilling or other similar means. The plug attachment means also can be removable, such as a threaded cap or friction fit device, which would allow for adjustment of the weighting material (16) thereby providing further variability in the weight of the putter head (10).

Referring to FIG. 1, in this embodiment, the weighting material is in the form of cylinders approximately by 3/4" in diameter, and the weighting chambers (14,15) are sized to friction fit the weighting material. The weighting chambers are approximately 1 11/16" long, and the cylinder used for weighting material, plus the plug totals approximately the same length. As the weighting chambers and weights approximately 120 grams in total. The length of the weighting material cylinder in this embodiment will vary depending on its density, and is approximately 1½ inches for lead. As shown in FIG. 3, in this embodiment, the body is approximately 1 13/16" from front to back as measured through the weighting chambers, and approximately 1 3/8" from front to back. As measured midway between the toe and heel. The body is approximately 1" from bottom to top, as shown in FIG. 2. On this embodiment, the length of the putter from toe to heel is approximately 3 5/8", as shown in FIG. 3. These dimensions can vary greatly for putter heads of varying weights, and for putter heads of different shapes or different configurations for the location of the weighting material relative to the polyurethane.

As shown in FIG. 4, the head (10) may have a face (20) for striking the ball. In this embodiment, the face is generally flat and at a small angle generally 2 to 7 degrees, to the vertical plane when the head is resting on its bottom 21. The putter head (10) can incorporate other design features of conventional golf putter heads, including functional and aesthetic features shown in FIG. 1. For example, the head bottom (21) may be tapered or rounded to reduce the likelihood the head (10) will tend to twist and disrupt the swing if the head contacts the ground during the swing. The shaping features can be incorporated along the longitudinal axis at the heel and toe, as well as the traverse axis, as shown in FIGS. 2 and 4.

The polyurethane also can be readily colored to create a variety of aesthetically pleasing colored putter heads (10). Conventional techniques are used to color the polyurethane. This permits a variety of different products with relatively little change in manufacturing methods.

What is claimed:

1. A golf putter head comprising a polyurethane body with a face, toe and heel, a toe weighting chamber, a heel weighting chamber, weighting material and toe plug in the toe weighting chamber and weighting material and heel plug in the heel weighting chamber, and a plug sealing means contacting the polyurethane body and sealing the toe plug in the toe chamber and heel plug in the heel chamber, connected so that no weighting material projects through the face, no weighting material is positioned between the heel weighting chamber and the toe weighting chamber and the toe weighting material and the heel weighting material are separated on the longitudinal axis of the body by no more than two inches.

2. A golf putter head of claim 1 in which the weighting material is from the group comprising lead, bronze, brass, tungsten, steel and zinc.

3. The golf putter head of claim 1 which has a face and a bottom on the body, which face is at an angle of approximately two to seven degrees from the vertical axis where the body is resting on the bottom.

4. The putter head of claim 1 which has a bottom which is rounded along the longitudinal axis of the body.

5. The golf putter head of claim 1 in which the bottom is rounded on the traverse axis of the body.

6. The golf putter head of claim 1 in which the plug sealing means is a flexible epoxy.

7. The golf putter head of claim 1 in which the head is between approximately 70 percent to 85 percent polyurethane by volume.

8. The golf putter head of claim 1 in which the polyurethane is colored.

9. A golf putter head comprising a polyurethane body with a face, toe and heel and weighting material in the toe and heel connected by molding the weighting material into the head so that no weighting material projects through the face, no weighting material is positioned between the toe weighting material and the heel weighting material, and the toe weighting material and the heel weighting material are separated on the longitudinal axis of the body by no more than two inches.

10. A golf putter head of claim 9 in which the weighting material is from the group comprising lead, bronze, brass, tungsten, steel and zinc.

11. The golf putter head of claim 9 which has a face and a bottom on the body, which face is at an angle of approximately two to seven degrees from the vertical axis where the body is resting on the bottom.

12. The putter head of claim 9 which has a bottom which is rounded along the longitudinal axis of the body.

13. The golf putter head of claim 9 in which the bottom is rounded on the traverse axis of the body.

14. The golf putter head of claim 9 in which the plug sealing means is a flexible epoxy.

15. The golf putter head of claim 9 in which the head is between approximately 70 percent to 85 percent polyurethane by volume.

16. The golf putter head of claim 9 in which the polyurethane is colored.

17. A golf putter head comprising a polyurethane body with a face, bottom, toe and heel and weighting material in the toe and heel connected by a strip of weighting material approximately parallel and close to the bottom so that the strip of weighting material acts as a sole plate to lower the center of gravity and so that no weighting material projects through the face or the bottom.

18. A golf putter head of claim 17 in which the weighting material is from the group comprising lead bronze, brass, tungsten, steel and zinc.

19. The golf putter head of claim 17 in which the face is at an angle of approximately two to seven degrees from the vertical axis where the body is resting on the bottom, and the bottom is rounded along the longitudinal axis of the body and along the traverse axis of the body.

20. The golf putter head of claim 17 in which the head is between approximately 70 percent to 85 percent polyurethane by volume.

* * * * *